US008668445B2

(12) United States Patent
Crespo et al.

(10) Patent No.: US 8,668,445 B2
(45) Date of Patent: Mar. 11, 2014

(54) VARIABLE TURBINE NOZZLE SYSTEM

(75) Inventors: Andres Jose Garcia Crespo, Greenville, SC (US); Robert Walter Coign, Piedmont, SC (US); David Richard Johns, Simpsonville, SC (US); Gary Charles Liotta, Greenville, SC (US)

(73) Assignee: General Electric Company, Schenectady, NY (US)

( * ) Notice: Subject to any disclaimer, the term of this patent is extended or adjusted under 35 U.S.C. 154(b) by 729 days.

(21) Appl. No.: 12/905,569

(22) Filed: Oct. 15, 2010

(65) Prior Publication Data

US 2012/0093632 A1 Apr. 19, 2012

(51) Int. Cl.
*F01D 9/04* (2006.01)
*F01D 9/06* (2006.01)

(52) U.S. Cl.
USPC ..... 415/160; 416/96 R

(58) Field of Classification Search
USPC ..... 415/115, 116, 151, 155, 159, 160, 162; 416/93 R, 96 R
See application file for complete search history.

(56) References Cited

U.S. PATENT DOCUMENTS 3,123,283 A * 3/1964 Leis ..... 415/115
3,471,126 A * 10/1969 Abild ..... 415/110
3,563,669 A 2/1971 Hockert et al.
3,588,269 A 6/1971 Wall, Jr.
3,652,177 A * 3/1972 Loebel ..... 415/110
3,674,337 A 7/1972 Marcatili
3,674,377 A 7/1972 Trappmann
3,719,427 A 3/1973 Davis
3,790,298 A 2/1974 Hendrickson et al.
3,966,352 A 6/1976 White et al.
3,990,810 A * 11/1976 Amos et al. ..... 415/161
4,013,377 A * 3/1977 Amos ..... 415/161
4,025,227 A 5/1977 Greenberg et al.
4,053,256 A 10/1977 Hertel
4,135,362 A 1/1979 Glenn
4,150,915 A 4/1979 Karstensen
4,163,629 A 8/1979 McDonough et al.
4,169,692 A 10/1979 McDonough et al.
4,187,054 A 2/1980 Landis, Jr. et al.
4,193,738 A 3/1980 Landis, Jr. et al.
4,214,851 A 7/1980 Tuley et al.
4,214,852 A 7/1980 Tuley et al.
4,861,228 A * 8/1989 Todman ..... 415/115
5,273,213 A 12/1993 Lewis
5,517,817 A 5/1996 Hines
5,683,225 A 11/1997 Orlando et al.
5,797,725 A * 8/1998 Rhodes ..... 415/209.2
5,931,636 A 8/1999 Savage et al.
5,941,537 A 8/1999 Wallace et al.

(Continued)

FOREIGN PATENT DOCUMENTS

EP 12277918 B1 2/2007

*Primary Examiner* — Edward Look
*Assistant Examiner* — Christopher R Legendre
(74) *Attorney, Agent, or Firm* — Hoffman Warnick LLC; Ernest G. Cusick

(57) ABSTRACT

A nozzle is disclosed for use in a turbine or compressor. In an embodiment, each of a plurality of vanes is supported by an outer shroud including a plurality of outer shroud segments disposed adjacent to adjoining segments in end-to-end relationship. Each segment includes a hole therethrough, dimensioned to receive a vane extension sleeve. This system may be used in conjunction with a modulated cooling system and may allow for improved removal for overhaul.

19 Claims, 8 Drawing Sheets

(56) References Cited

U.S. PATENT DOCUMENTS

| | | | | |
|---|---|---|---|---|
| 6,190,133 | B1 | 2/2001 | Ress, Jr. et al. | |
| 6,913,440 | B2 | 7/2005 | Ciacci et al. | |
| 6,981,841 | B2 | 1/2006 | Krammer et al. | |
| 7,445,427 | B2 * | 11/2008 | Gutknecht et al. | 415/160 |
| 2012/0093632 | A1 * | 4/2012 | Crespo et al. | 415/151 |

* cited by examiner

VARIABLE TURBINE NOZZLE SYSTEM

BACKGROUND OF THE INVENTION

The disclosure relates generally to turbine technology. More particularly, the disclosure relates to a variable area nozzle, for use in a multi-stage turbine.

In the design of gas turbine engines, fluid flow through the engine is varied by a plurality of stator vanes and rotor blades. Typically, static nozzle segments direct flow of a working fluid into stages of turbine blades connected to a rotating rotor. Each nozzle has an airfoil or vane shape configured such that when a set of nozzles are positioned about a rotor of the turbine, they direct the gas flow in an optimal direction and with an optimal pressure against the rotor blades.

Directional and pressure requirements may vary with changes in operating conditions including temperature, engine mass flow, and so forth. Static vanes may not provide optimal direction and pressure over a full range of operating conditions, resulting in decreased efficiency and/or a harsher than necessary environment for components. Further, static vanes have a finite lifespan, due to the harsh environment inside a turbine, which may be maintained at significant pressure and temperature, e.g., 982-1093° C. (1800-2000° F.). Repair and replacement of static vanes typically requires disassembly of a turbine, which is costly in both labor and down time for the machine.

A number of designs have incorporated variable vanes in an effort to enhance flow direction and pressure. Variable vanes have been used having a hollow passage configured to accommodate a support strut and an inner strut, and to provide cooling air flow to the inner strut in the vicinity of the variable vane. Rotation of the vane to adjust angle has been accomplished through sleeve bearings. However, this design may fail to address prolonged field operation due to wear issues on mating components, and may require regular overhaul.

Other designs have been used, including a variable area turbine entrance nozzle having moveable vanes which are rotated in the middle stage of a turbine engine. The moveable vanes are sealed against the outer casing and the rotor to prevent leakage of air therethrough. This design may also be unsuitable for prolonged field operation, however, and regular overhauls are costly in both labor and turbine down time.

BRIEF DESCRIPTION OF THE INVENTION

A first aspect of the disclosure provides a nozzle for a turbine, the nozzle comprising a vane having an airfoil shape; an outer shroud segment for mounting the vane, the outer shroud segment including a radially extending hole therethrough. The outer shroud segment further comprises a radially extending vane passage for allowing radial removal of the vane therethrough.

A second aspect of the disclosure provides a nozzle for a turbine, the nozzle comprising: a vane having an airfoil shape; an outer shroud segment for mounting the vane, the outer shroud segment including a radially extending hole therethrough; a vane extension sleeve dimensioned to be inserted into the hole; a bushing disposed on an interior of the vane extension sleeve; a vane extension journal operably coupled to the vane, wherein the vane extension journal includes a vane extension flange member dimensioned to be inserted into the radially extending hole in the outer shroud segment, and a vane extension shaft member dimensioned to be disposed within the bushing, the vane extension journal further being in operable connection with an actuator for actuating a rotation of a vane, the rotation varying a surface area of the vane exposed to a fluid flow path.

A third aspect of the disclosure provides a turbo-machine comprising a rotating shaft; a plurality of blades extending from the rotating shaft; a casing surrounding the plurality of blades and defining a flow path; and a nozzle adjacent to the plurality of blades for directing a fluid flow to the plurality of blades. The nozzle further comprises: a vane having an airfoil shape; an outer shroud segment for mounting the vane, the outer shroud segment including a radially extending hole therethrough. The outer shroud segment further comprises a radially extending vane passage for allowing radial removal of the vane therethrough, the radially extending vane passage further comprising: a leading edge passage adjacent to the radially extending hole, the leading edge passage having a shape and a dimension substantially matching a shape and a dimension of a leading edge of the vane; and a trailing edge passage adjacent to the radially extending hole, the trailing edge passage having a shape and a dimension substantially matching a shape and a dimension of a trailing edge of the vane. The leading edge passage and the trailing edge passage are in radial alignment with the leading edge and the trailing edge of the vane.

These and other aspects, advantages and salient features of the invention will become apparent from the following detailed description, which, when taken in conjunction with the annexed drawings, where like parts are designated by like reference characters throughout the drawings, disclose embodiments of the invention.

DETAILED DESCRIPTION OF THE INVENTION

At least one embodiment of the present invention is described below in reference to its application in connection with the operation of a turbo-machine. Although embodiments of the invention are illustrated relative to a turbo-machine in the form of a gas turbine, it is understood that the teachings are equally applicable to other turbo-machines including, but not limited to, other types of turbines or compressors. Further, at least one embodiment of the present invention is described below in reference to a nominal size and including a set of nominal dimensions. However, it should be apparent to those skilled in the art that the present invention is likewise applicable to any suitable turbine and/or compressor. Further, it should be apparent to those skilled in the art that the present invention is likewise applicable to various scales of the nominal size and/or nominal dimensions.

As indicated above, aspects of the invention provide a nozzle and a turbine including a nozzle which may be removed without disassembling the turbine. Further aspects provide a nozzle and a turbine including a nozzle that includes variable area vanes and modulated cooling thereof.

Figure 1:
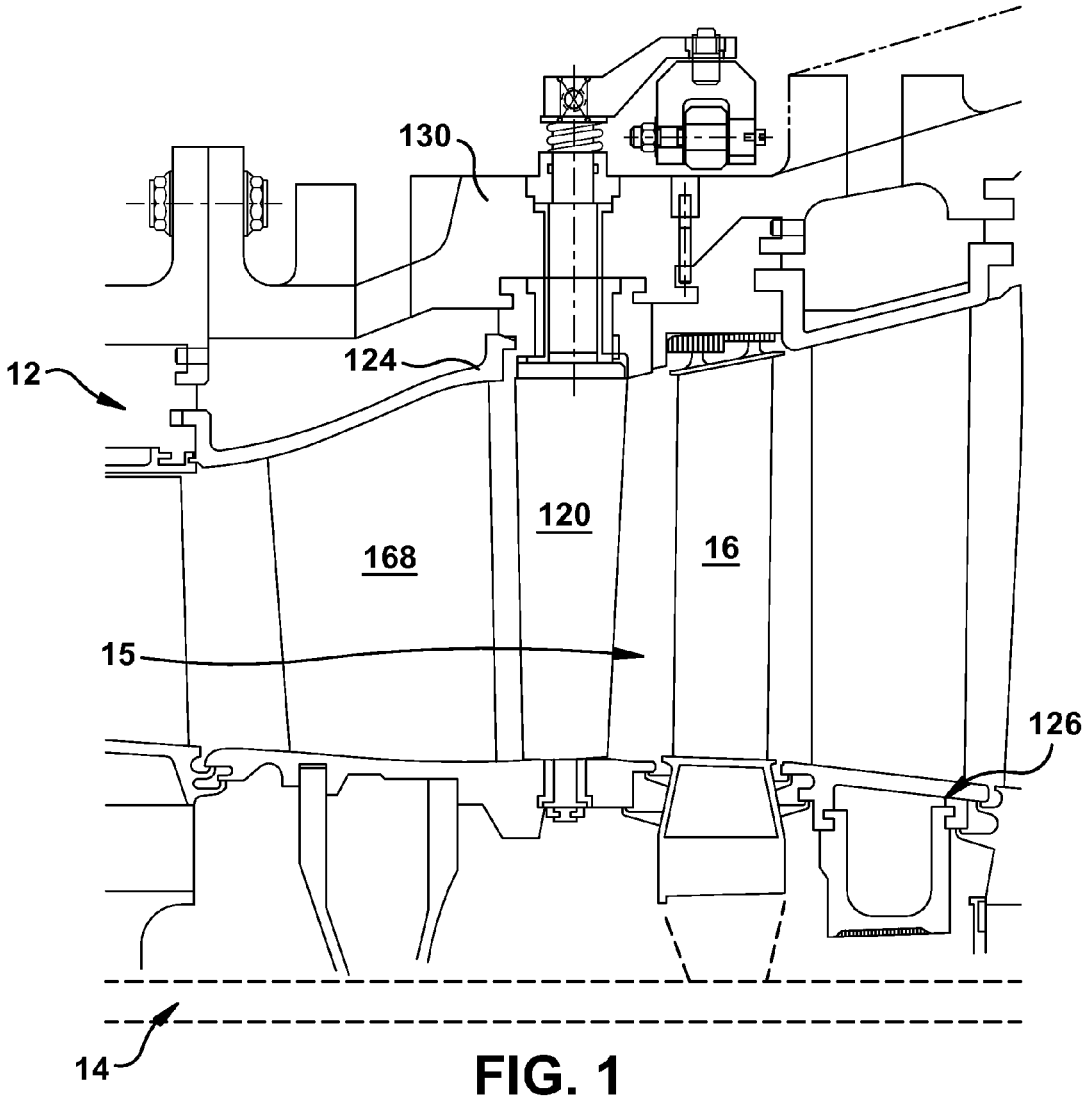
FIG. 1 shows a cross-sectional view of a portion of a nozzle set within a turbine.

Referring to the drawings, FIG. 1 shows a cross-sectional view of a portion of a nozzle set within a turbine 12. As understood, turbine 12 includes a rotor including a rotating shaft 14 having a plurality of blades 16 extending therefrom at different stages. Blades 16 extend radially from rotating shaft 14 (shown in phantom) and, under the force of a fluid flow 15, act to rotate rotating shaft 14. A nozzle set is positioned before each stage of plurality of blades 16 to direct fluid flow 15 to the plurality of blades with the appropriate angle of attack and pressure. An outer casing 130 further surrounds blades 16 and contains and directs fluid flow 15 through the stages of turbine 12.

Figure 2:
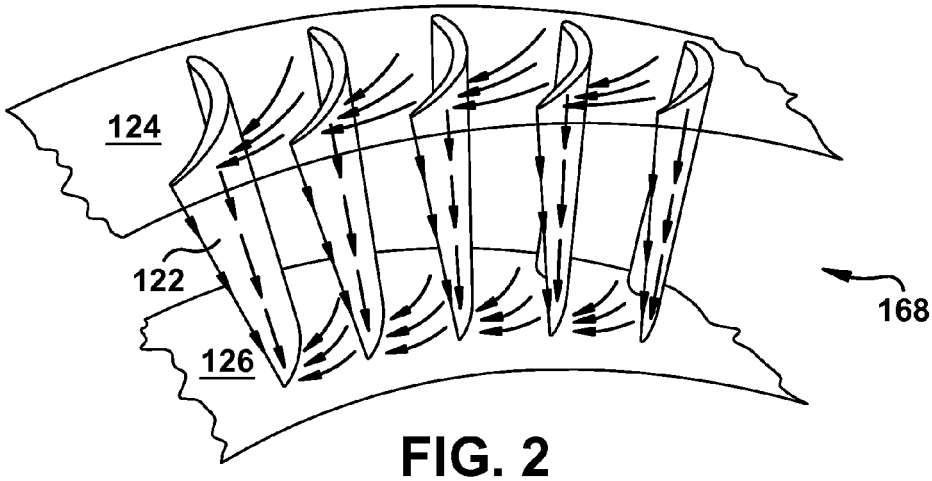
FIG. 2 shows a perspective view of a portion of a nozzle.

As shown in FIG. 2, each nozzle 168 includes a vane 122 that is coupled at a radially outer and radially inner end thereof to a radially outer shroud 124 and a radially inner shroud 126, respectively. Where vanes 122 are immovably coupled to outer and inner shrouds 124, 126, the angle of attack may be set to accommodate a specific range or set of operating conditions, including temperature, engine mass flow, and so on. A space between nozzles 168 at radially inner shroud 126 may either be non-existent because of mating airfoil surfaces, or may be provided by a plate portion of radially inner shroud 126. A space between nozzles 120 at radially outer shroud 124 may be provided by a plate portion of radially outer shroud 124.

Turning to FIGS. 3-11, a nozzle 120 and turbine including nozzle 120 will be described in accordance with embodiments of the invention.

Figure 3:
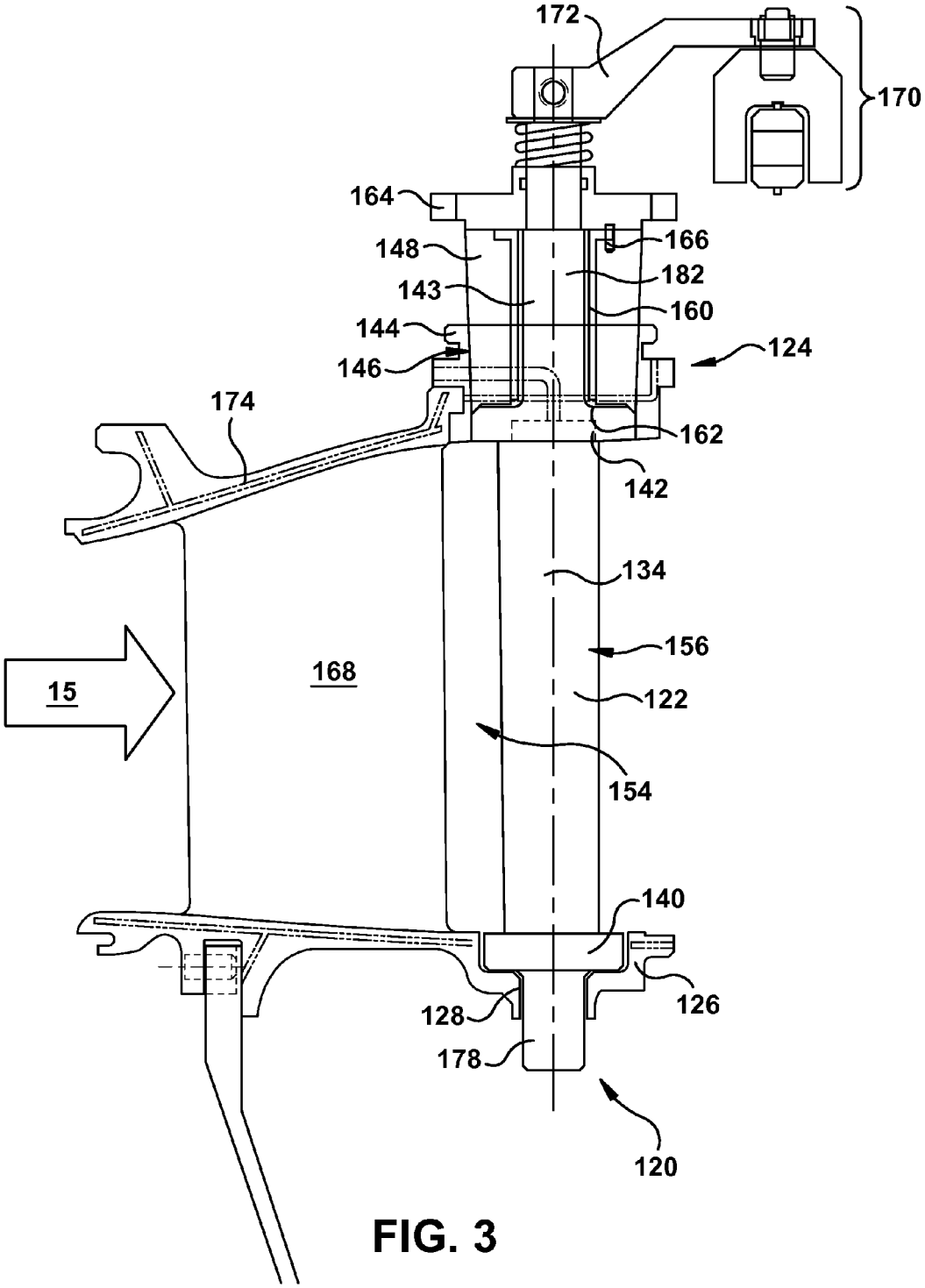
FIG. 3 shows a cross sectional view of a nozzle in accordance with an embodiment of the disclosure.
Figure 4:
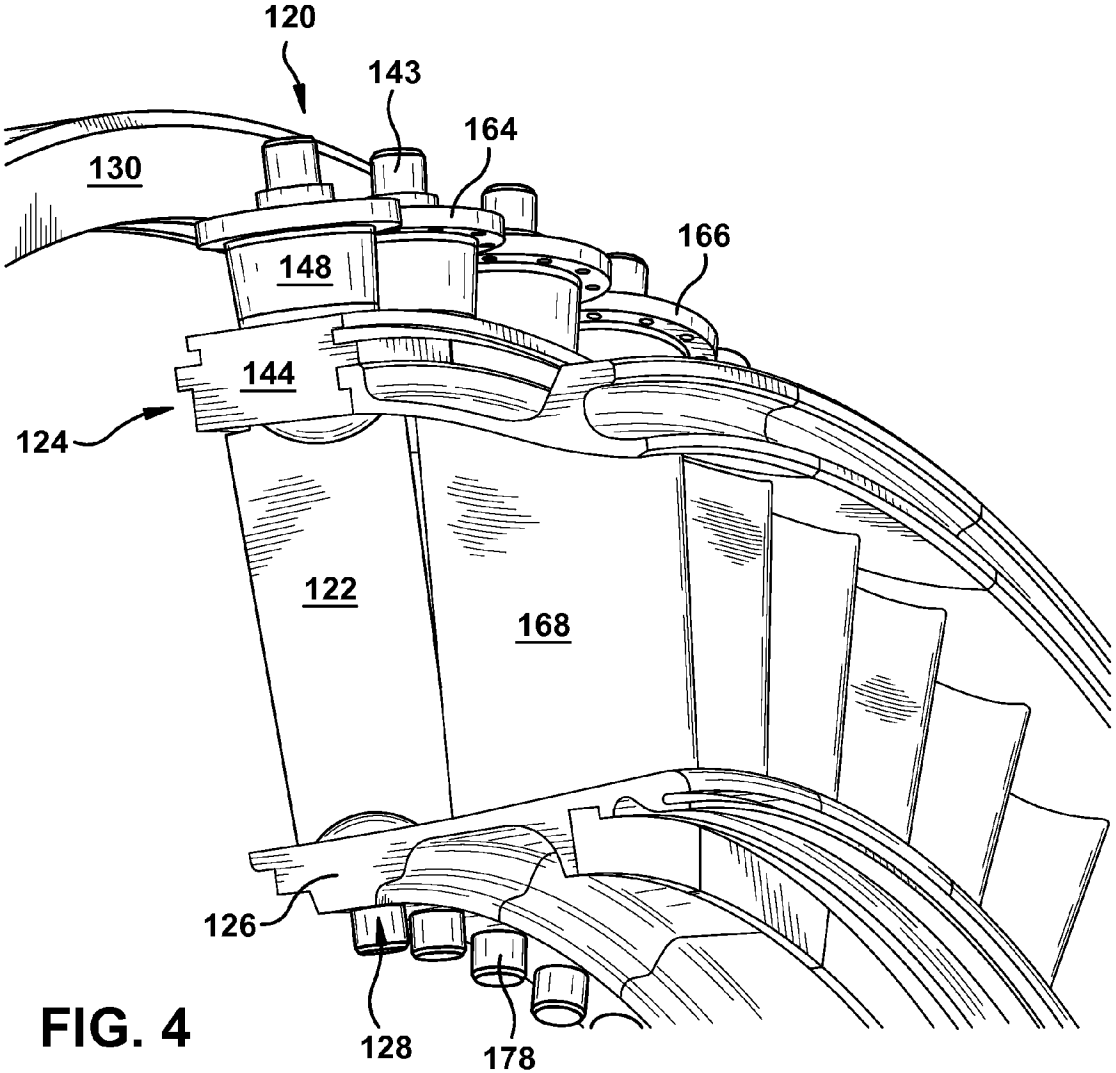
FIGS. 4-5 show perspective views of a nozzle in accordance with an embodiment of the disclosure.
Figure 5:
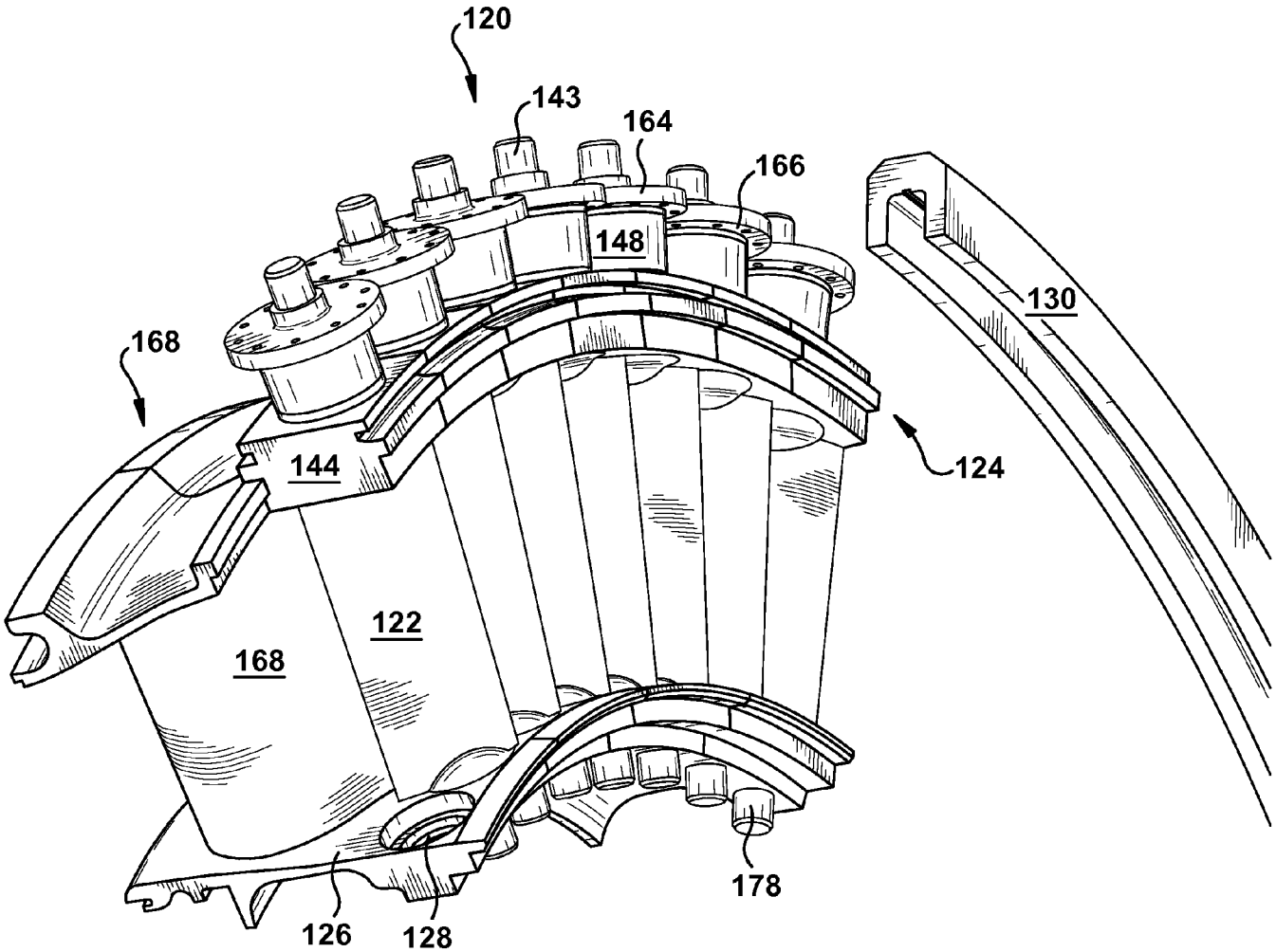
Figure 6:
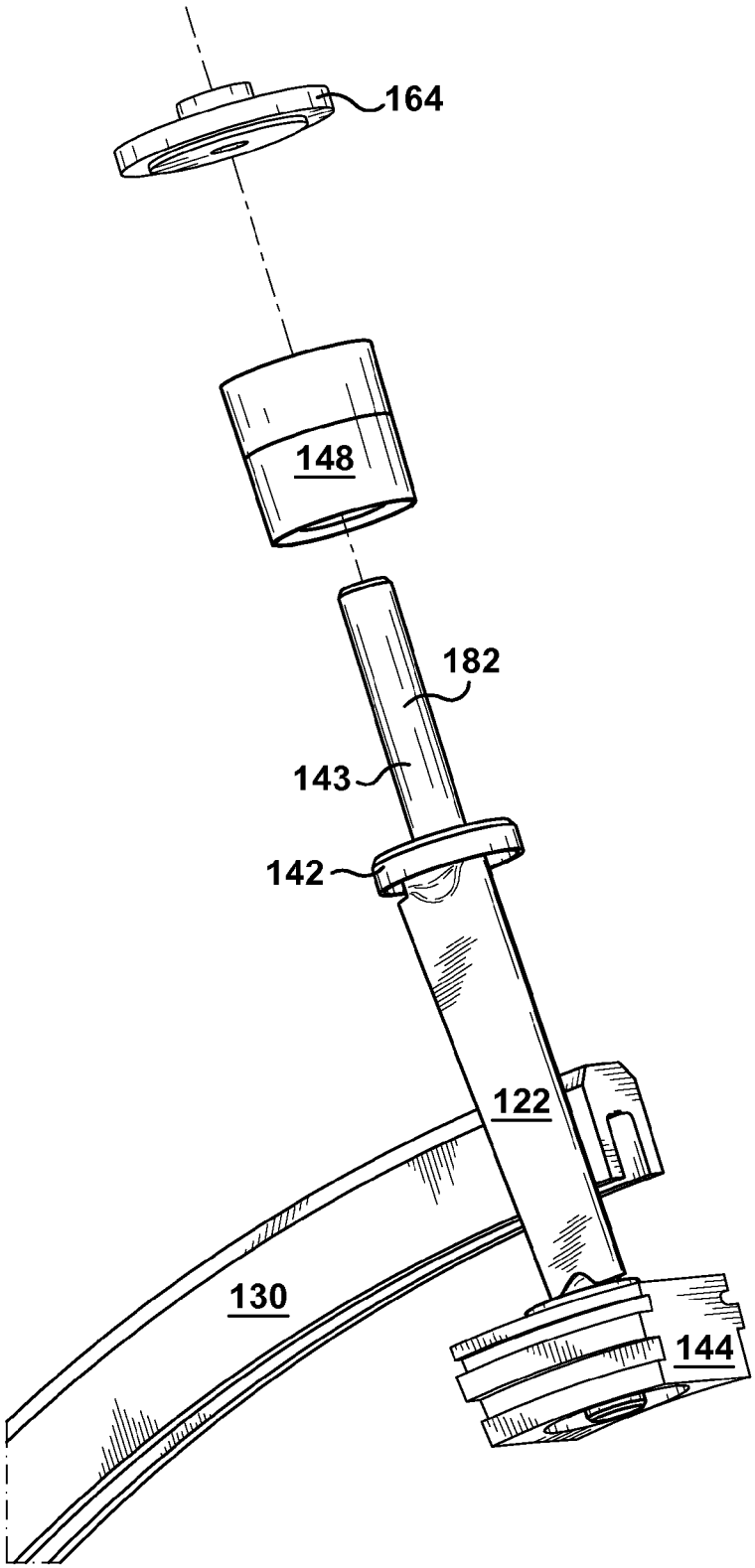
FIG. 6 shows a perspective exploded view of a nozzle in accordance with an embodiment of the disclosure.

As shown in the embodiments depicted in FIGS. 3-5, nozzle 120 includes inner shroud 126 which encircles a diameter of a rotating shaft (as shown in FIG. 1). Inner shroud 126 may include a plurality of holes 128 therethrough. Nozzle 120 further includes a plurality of vanes 122 having an airfoil shape, vanes 122 being rotatably disposed between an outer casing 130 of turbine 12 and inner shroud 126 as in FIGS. 4-5. Nozzle 120 may include the same number of vanes 122 as holes 128 in inner shroud 126. A cylindrical flange 140 may function as a bearing, and may be positioned at a first, inner end of the vane 122, for sealing a leading edge of vane 122 at inner shroud 126. First cylindrical flange 140 may be toroidally, or ring-shaped and may have an outer diameter approximately equal to that of hole 128 in inner shroud 126.

As further depicted in FIGS. 3-5, each of the plurality of vanes 122 is further supported by an outer shroud 124. Outer shroud 124 is composed of a plurality of outer shroud segments 144, each segment 144 disposed adjacent to an adjoining outer shroud segment 144 in end-to-end relationship as shown in FIGS. 4-5. Outer shroud 124 may be connected to an inner surface of the outer casing 130 (FIGS. 4-5) by any now known or later developed couplings, e.g., mating hooks.

Figure 7:
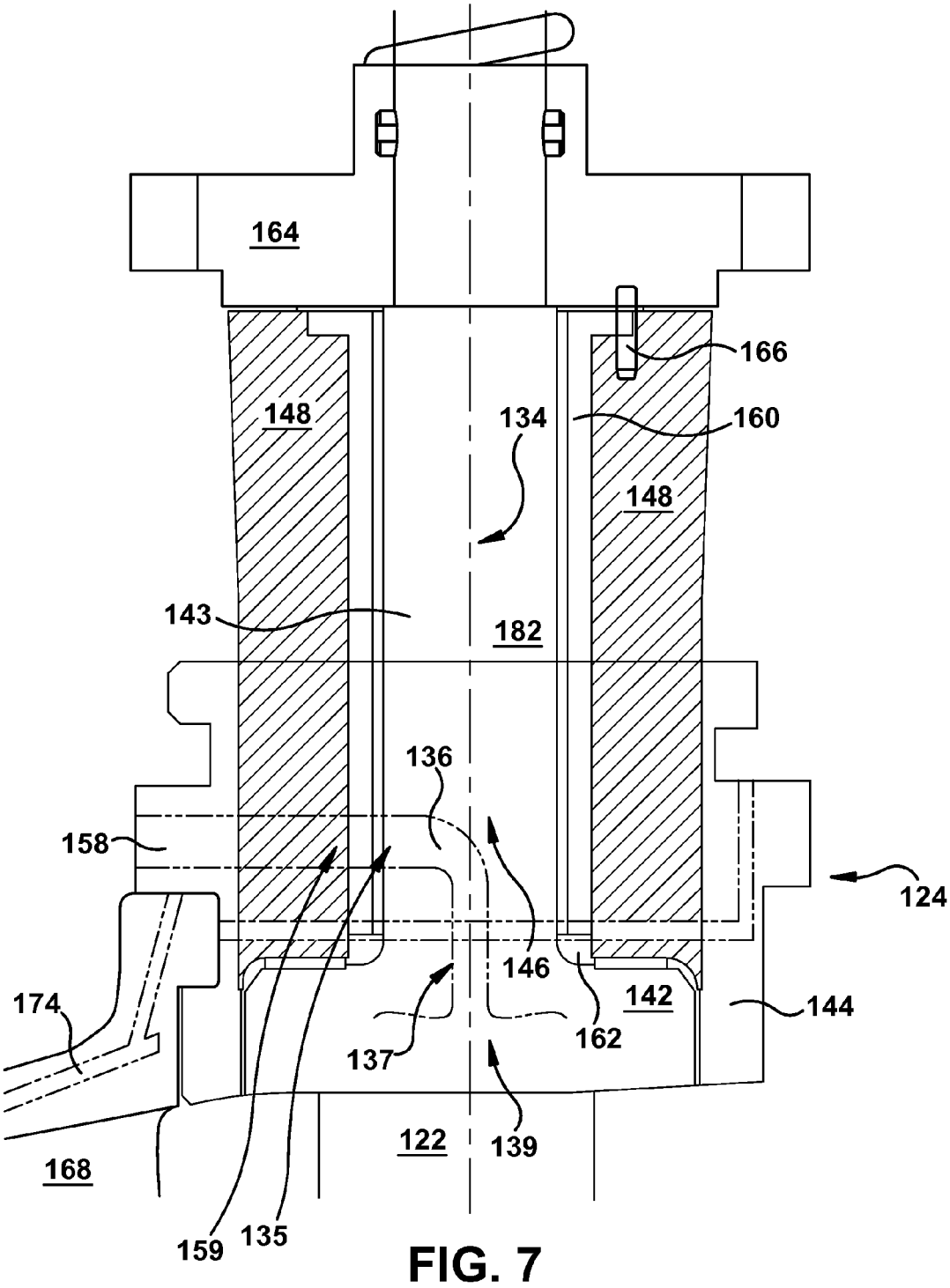
FIG. 7 shows an enlarged cross sectional view of part of the nozzle of FIG. 3.

Each vane 122 may be mounted to an outer shroud segment 144 in accordance with embodiments of the invention. Each outer shroud segment 144 includes a substantially cylindrical hole 146 which extends radially through the full thickness of outer shroud segment 144. Vane extension sleeve 148, which is substantially tubular in shape, may be inserted into hole 146 from a radially exterior side, acting as a plug in hole 146, aiding in defining a fluid flow path 15 through turbine 12. When inserted into hole 146, vane extension sleeve 148 may not be inserted into the full thickness of hole 146 in outer shroud segment 144, and may protrude from hole 146 in a radially outward direction, as depicted in FIGS. 3 and 7. Vane extension sleeve 148 further includes a bushing 160 disposed within the interior lumen of vane extension sleeve 148. Bushing 160 provides a wear surface on an interior of vane extension sleeve 148. A vane extension journal 182 is further disposed within bushing 160, and may rotate therein.

Vane extension journal 182 may include at least a flange member 142 and a shaft member 143 extending from a face of the flange member in a t-shape, as shown in FIG. 7. In various embodiments, flange member 142 and shaft member 143 may be formed as a unitary vane extension journal 182 piece, or may be formed of two or more separate pieces. Flange member 142 is substantially toroidal in shape, and may have an outer diameter substantially equal to the inner diameter of hole 146. Shaft member 143 may have an outer diameter that is smaller than an inner diameter of bushing 160. Shaft member may further be long enough that when vane extension journal 182 is disposed within bushing 160, shaft member 143 may extend radially outward beyond vane extension sleeve 148 and through flange 164, discussed further below. Vane extension journal 182 may be disposed within outer shroud segment 144, with shaft member 143 disposed within bushing 160, and flange member 142 disposed within hole 146, radially inward of vane extension sleeve 148, as shown in FIG. 7. As both flange member 142 and vane extension sleeve 148 each have an outer diameter substantially the same as the inner diameter of hole 146, they have substantially the same outer diameter as one another.

As further shown in FIGS. 3 and 7, a flange 164 may be used to seal and secure nozzle 120. Flange 164 is disposed radially outward of vane extension sleeve 148 and on and external side of casing 130, allowing shaft member 143 to pass through a hole therethrough. Flange 164 may be affixed to vane extension sleeve 148 by any of a number of means such as bolts 166.

As shown in FIG. 3, vane extension journal 182 may be operably coupled with vane 122 by flange member 142, and to an actuator 170 by shaft member 143, which protrudes radially outwardly through flange 164 as previously mentioned. Actuator 170 may actuate a rotation of vane 122 about a vane axis 134 extending radially from a centerline of turbine 12, as shown in FIG. 3. This rotation varies a surface area of vane 122 that is exposed to a fluid flow path 15, moving the vane in and out of phase with the moving fluid. Actuator 170 may include a rotating mechanical arm 172 in operable coupling with shaft member 143 of vane extension journal 182. Mechanical arm 172 may be located on an exterior of casing 130, thus allowing fine grain adjustment of the angular position of vanes 122 for maximally efficient operation at a given set of operating conditions, including engine speed, ambient conditions, and load requirements, among others.

Figure 11:
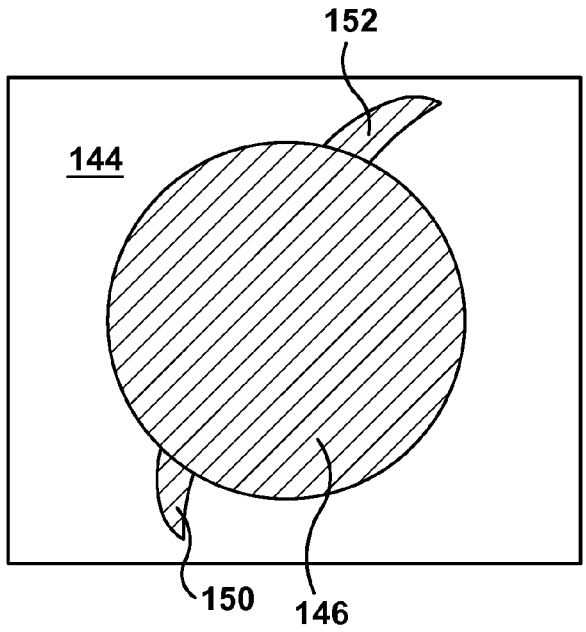
FIG. 11 shows a plan view of an outer shroud segment in accordance with an embodiment of the disclosure.

As shown in FIG. 11, each outer shroud segment 144 further includes a leading edge passage 150 and a trailing edge passage 152. Leading and trailing edge passages 150, 152 are each adjacent to radially extending hole 146 and on opposite sides thereof. Leading edge passage 150 has a shape and a dimension substantially matching a shape and a dimension of a portion of leading edge 154 of vane 122 which extends laterally beyond hole 146. Leading edge passage 150 may be located directly radially outward of, and in alignment with, leading edge 154. Similarly, trailing edge passage 152 has a shape and a dimension substantially matching a shape and a dimension of the portion of trailing edge 156 of vane 122 which extends laterally beyond hole 146, and may be located directly radially outward of, and in alignment with, trailing edge 156. Hole 146 and leading and trailing edge extending passages 150, 152 are aligned such that vane 122 may pass through the contiguous collective vane passage 157 in outer shroud segment 144 formed by passages 150, 152 and hole 146, allowing removal of vane 122 in a radially outward direction through outer shroud 124. This facilitates overhaul without dismantling outer shroud 124. Vanes 122 may further be inserted into turbine 12 in the same fashion, through outer shroud 124 and casing 130 via the collective passage formed by hole 146 and leading and trailing edge passages 150, 152.

Referring back to FIG. 7, outer shroud segment 144 further includes a first cooling passage 158 which runs through outer shroud segment 144 from an outer surface toward an inner surface of hole 146. First cooling passage 158 terminates at a static aperture 159, located near an inner surface of hole 146. Static aperture 159 may be shaped and dimensioned to facilitate metering of a flow therethrough, tailored to a heat load of fluid flow 15 at each angle of vanes 122. Aperture 159 may be round or rectangular in shape, but may also be any other geometric shape that facilitates such flow rate adjustment. A second cooling passage 136, having a first end 135 and a second end 137, may be located within the vane extension journal 182. The second cooling passage 136 may be in fluid communication at first end 135 with first cooling passage 158 at static aperture 159. Second cooling passage 136 may proceed laterally through bushing 160 and shaft member 143 of vane extension journal 182 approximately as far as axis 134. Bushing 160 is keyed such that its shape acts to seal the leading and trailing edge passages 150, 152 in outer shroud segment 144, and accommodates first cooling passage 158. A sealing gasket 162 (FIG. 7) or plurality of gaskets contribute to the seal formed about vane extension sleeve 148. Gasket 162 may be disposed between the vane extension sleeve 148 and the vane extension flange member 142. These seals substantially prevent leakage of fluid from flow path 15, maintaining efficiency of turbine 12.

Once second cooling passage 136 reaches approximately the vane axis 134, second cooling passage 136 may turn radially inward, traversing the longitudinal axis 134 of shaft 143, to conduct fluid radially inwardly along axis 134. Second cooling passage 136 terminates at second end 137 at an inlet plenum 139.

Figure 8:
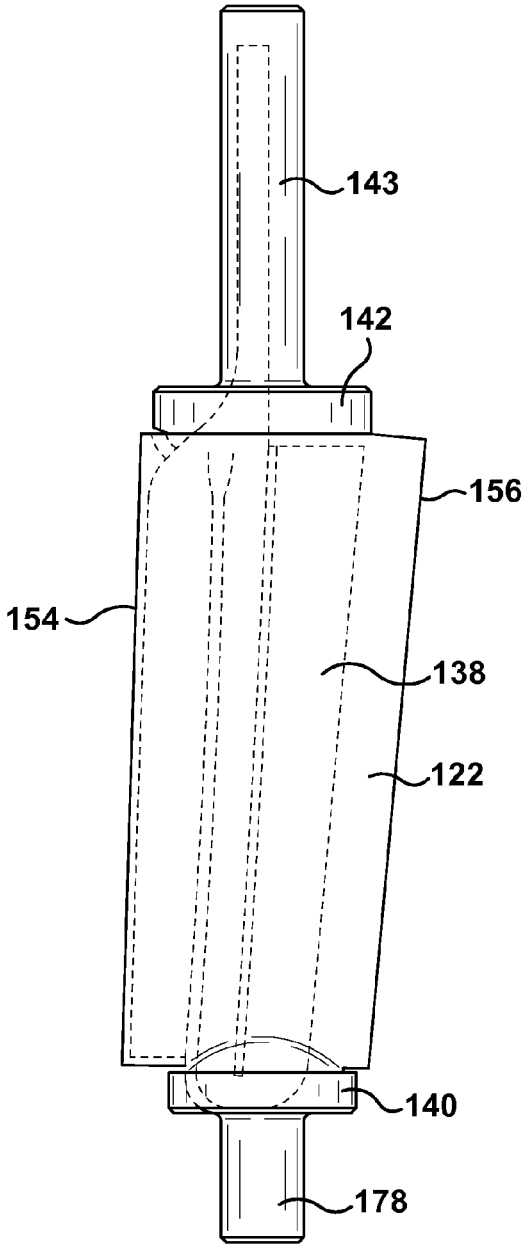
FIG. 8 shows a cross sectional view of a vane in accordance with an embodiment of the disclosure.
Figure 9:
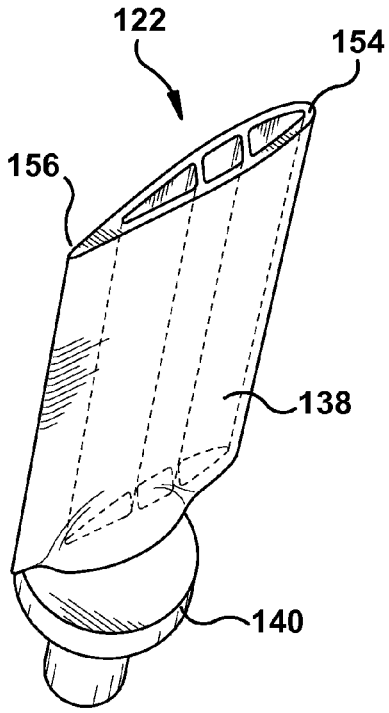
FIG. 9 shows a perspective view of a vane in accordance with an embodiment of the disclosure.

Third cooling passage 138, located in vane 122 and shown in detail in FIGS. 8-9, functions to cool vane 122 during turbine operation. In various embodiments, cooling passages 138 may be a single passage, or may comprise multiple fluidly connected passages arranged to cool vane 122. Third cooling passage 138 may be in fluid communication with second cooling passage 136 at the inlet plenum 139.

In an embodiment, inner shroud 126 is integrally cast with a static nozzle 168, located adjacent to nozzle 120 within turbine 12, as shown in FIGS. 4-5. An inner vane extension sleeve 178, similar to vane extension sleeve 148, may be used in holes 128 in inner shroud 126 to secure vanes 122. In some embodiments, static nozzle 168 may be mounted such that it precedes nozzle 120 in the flow path 15, such that fluid flows over static nozzle 168 before it reaches nozzle 120. Static nozzle 168 may further include a fourth cooling passage 174 in fluid communication with the first cooling passage 158 as shown in FIG. 7. Fluid flows through the foregoing fluidly connected cooling passages in a direction from fourth cooling passage 174 to first cooling passage 158 to second cooling passage 136 to third cooling passage 138.

Any heat transfer medium may be used to flow through the foregoing cooling passages in fluid communication with one another, to cool inner parts of vane 122. In various embodiments, any one or more of first cooling passage 158, the second cooling passage 136, the third cooling passage 138, or the fourth cooling passage 174 may be further outfitted with a heat transfer enhancement surface such as, e.g., pins, turbulators, etc., for increasing the cooling of features of nozzle 120.

Figure 10:
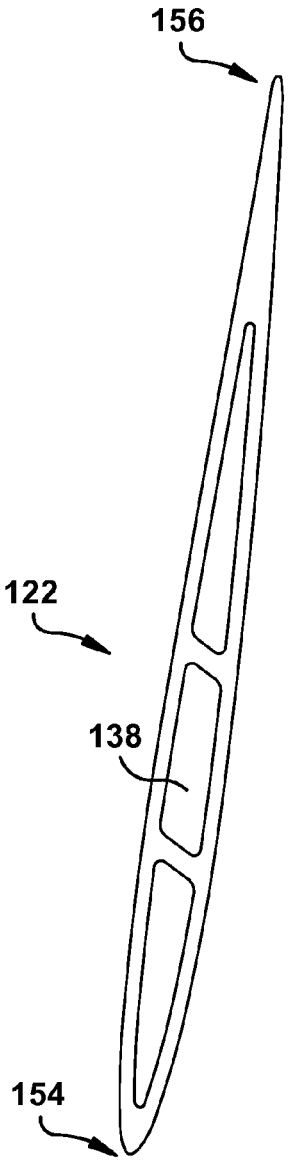
FIG. 10 shows a plan view of a vane in accordance with an embodiment of the disclosure.

Vanes 122 may further be substantially cored, or hollow, as shown in FIG. 10. As vane 122 is rotated by vane extension journal 182 and actuator 170, vane 122 moves in and out of phase with fluid flow path 15, varying the amount of surface area of vane 122 exposed to fluid path 15. Thus flow path 15 can be substantially opened and closed by the position of vanes 122. This allows for balancing of turbine efficiency and cooling. When vanes 122 are substantially closed, i.e., a large surface area of vane 122 is exposed to flow path 15, more cooling is needed, but turbine 12 works more efficiently. When vanes 122 are substantially open, i.e. less surface area of vanes 122 is exposed to flow path 15, less cooling is needed, but turbine 12 works less efficiently.

Through the motion initiated by actuator 170, vane extension journal 182 and vane 122 may be rotated about vane axis 134, causing second cooling passage 136 in vane extension journal 182 to rotate or slide past static aperture 159 (FIG. 7) in addition to adjusting the position of vane 122. In this way, the fluid flow into third cooling passage 138 and flow path 15 may be controlled or modulated. Fluid entering cooling passage 136 in vane 122 can be modulated in accordance with a cooling requirement of vane 122 as determined based on operating parameters or conditions of turbine 12.

Technical effects of the various embodiments of the present invention include providing a variable area nozzle 120 for a turbine 12, with a modulated cooling system which can be adjusted in accordance with present operating conditions. Other technical effects associated with the various embodiments of the present invention include providing a nozzle 120, the vanes 122 of which may be repaired or replaced without disassembling turbine 12 or removing casing 130, thus saving both time and cost.

As used herein, the terms "first," "second," and the like, do not denote any order, quantity, or importance, but rather are used to distinguish one element from another, and the terms "a" and "an" herein do not denote a limitation of quantity, but rather denote the presence of at least one of the referenced item. The modifier "about" used in connection with a quantity is inclusive of the stated value and has the meaning dictated by the context (e.g., includes the degree of error associated with measurement of the particular quantity). The suffix "(s)" as used herein is intended to include both the singular and the plural of the term that it modifies, thereby including one or more of that term (e.g., the metal(s) includes one or more metals). Ranges disclosed herein are inclusive and independently combinable (e.g., ranges of "up to about 25 mm, or, more specifically, about 5 mm to about 20 mm," is inclusive of the endpoints and all intermediate values of the ranges of "about 5 mm to about 25 mm," etc.).

While various embodiments are described herein, it will be appreciated from the specification that various combinations of elements, variations or improvements therein may be made by those skilled in the art, and are within the scope of the invention. In addition, many modifications may be made to adapt a particular situation or material to the teachings of the invention without departing from essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A turbo-machine comprising:

a rotor including a rotating shaft and a plurality of blades extending from the rotating shaft;

a casing surrounding the plurality of blades and defining a flow path; and a nozzle adjacent to the plurality of blades for directing a fluid flow to the plurality of blades, the nozzle comprising:

a vane having an airfoil shape;

an outer shroud segment further comprising a radially extending vane passage for allowing radial removal of the vane therethrough, wherein the radially extending vane passage further comprises:

a leading edge passage adjacent to the radially extending hole, the leading edge passage having a shape and a dimension substantially matching a shape and a dimension of a leading edge of the vane; and a trailing edge passage adjacent to the radially extending hole, the trailing edge passage having a shape and a dimension substantially matching a shape and a dimension of a trailing edge of the vane;

wherein the leading edge passage and the trailing edge passage are in radial alignment with the leading edge and the trailing edge of the vane.

2. The turbo-machine of claim 1, wherein the nozzle further comprises:

a vane extension sleeve dimensioned to be inserted into the hole;

a bushing disposed on an interior of the vane extension sleeve;

a vane extension journal operably coupled to the vane, wherein the vane extension journal includes:

a vane extension flange member dimensioned to be inserted into the radially extending hole in the outer shroud segment, and a vane extension shaft member dimensioned to be disposed within the bushing, the vane extension journal further being in operable connection with an actuator for actuating a rotation of the vane, the rotation varying a surface area of the vane exposed to a fluid flow path;

a first cooling passage in the outer shroud segment, wherein the first cooling passage terminates at a static aperture;

a second cooling passage in the vane extension journal, the second cooling passage being in fluid communication at a first end thereof with the first cooling passage at the static aperture, and the second cooling passage terminating at a second end thereof at an inlet plenum; and a third cooling passage in the vane, wherein the third cooling passage is in fluid communication with the second cooling passage at the inlet plenum, wherein a fluid flows from the first cooling passage to the second cooling passage to the third cooling passage.

3. A nozzle for a turbine, the nozzle comprising:

a vane having an airfoil shape;

an outer shroud segment for mounting the vane, the outer shroud segment including a radially extending hole therethrough;

the outer shroud segment further comprising a radially extending vane passage for allowing radial removal of the vane therethrough, wherein the radially extending vane passage further comprises:

a leading edge passage adjacent to the radially extending hole, the leading edge passage having a shape and a dimension substantially matching a shape and a dimension of a leading edge of the vane, and a trailing edge passage adjacent to the radially extending hole, the trailing edge passage having a shape and a dimension substantially matching a shape and a dimension of a trailing edge of the vane, wherein the leading edge passage and the trailing edge passage are in radial alignment with the leading edge and the trailing edge of the vane.

4. The nozzle of claim 3, wherein the nozzle further comprises:

a vane extension sleeve dimensioned to be inserted into the hole;

a bushing disposed on an interior of the vane extension sleeve;

a vane extension journal operably coupled to the vane, wherein the vane extension journal includes:

a vane extension flange member dimensioned to be inserted into the radially extending hole in the outer shroud segment, and a vane extension shaft member dimensioned to be disposed within the bushing, the vane extension journal further being in operable connection with an actuator for actuating a rotation of the vane, wherein the rotation varies a surface area of the vane exposed to a fluid flow path.

5. The nozzle of claim 4, further comprising:

a first cooling passage in the outer shroud segment, wherein the first cooling passage terminates at a static aperture; and a second cooling passage in the vane extension journal, the second cooling passage being in fluid communication at a first end thereof with the first cooling passage at the static aperture, and the second cooling passage terminating at a second end thereof at an inlet plenum, wherein the rotation of the vane extension journal and the vane by the actuator causes the first end of the second cooling passage to rotate past the static aperture, modulating a rate of fluid flow.

6. The nozzle of claim 5, further comprising a third cooling passage in the vane, wherein the third cooling passage is in fluid communication with the second cooling passage at the inlet plenum, wherein a fluid flows from the first cooling passage to the second cooling passage to the third cooling passage.

7. The nozzle of claim 5, wherein the rate of fluid flow is modulated in accordance with a cooling requirement of the vane at a set of operating conditions.

8. The nozzle of claim 5, further comprising an inner shroud supporting the vane, wherein the inner shroud is integrally cast with a static nozzle adjacent to the nozzle in the turbine;

wherein the static nozzle further includes a fourth cooling passage in fluid communication with the first cooling passage.

9. The nozzle of claim 4, wherein the actuator further comprises a rotating mechanical arm in operable connection with the vane extension journal, the mechanical arm being located on an exterior of a casing.

10. The nozzle of claim 4, wherein the nozzle further comprises:

at least one gasket disposed between the vane extension sleeve and the vane extension flange member, providing a seal; and a flange disposed radially outward of the vane extension sleeve and affixed to the vane extension sleeve, for securing a nozzle.

11. A nozzle for a turbine, the nozzle comprising:

a vane having an airfoil shape;

an outer shroud segment for mounting the vane, the outer shroud segment including a radially extending hole therethrough;

a vane extension sleeve dimensioned to be inserted into the hole;

a bushing disposed on an interior of the vane extension sleeve;

a vane extension journal operably coupled to the vane, wherein the vane extension journal includes:

a vane extension flange member dimensioned to be inserted into the radially extending hole in the outer shroud segment, and a vane extension shaft member dimensioned to be disposed within the bushing, the vane extension journal further being in operable connection with an actuator for actuating a rotation of the vane, wherein the rotation varies a surface area of the vane exposed to a fluid flow path.

12. The nozzle of claim 11, further comprising:

a first cooling passage in the outer shroud segment, wherein the first cooling passage terminates at a static aperture; and a second cooling passage in the vane extension journal, the second cooling passage being in fluid communication at a first end thereof with the first cooling passage at the static aperture, and the second cooling passage terminating at a second end thereof at an inlet plenum, wherein the rotation of the vane extension journal and the vane by the actuator causes the first end of the second cooling passage to rotate past the static aperture, modulating a rate of fluid flow.

13. The nozzle of claim 12, further comprising a third cooling passage in the vane, wherein the third cooling passage is in fluid communication with the second cooling passage at the inlet plenum, and wherein a fluid flows from the first cooling passage to the second cooling passage to the third cooling passage.

14. The nozzle of claim 12, further comprising an inner shroud supporting the vane, wherein the inner shroud is integrally cast with a static nozzle adjacent to the nozzle in the turbine;

wherein the static nozzle further includes a fourth cooling passage in fluid communication with the first cooling passage.

15. The nozzle of claim 12, wherein the rate of fluid flow is modulated in accordance with a cooling requirement of the vane at a set of operating conditions.

16. The nozzle of claim 12, wherein one or more of the first cooling passage or the second cooling passage is further outfitted with a heat transfer enhancement surface.

17. The nozzle of claim 11, wherein the outer shroud segment further comprises a radially extending vane passage for allowing radial removal of the vane therethrough, wherein the radially extending vane passage further comprises:

a leading edge passage adjacent to the radially extending hole, the leading edge passage having a shape and a dimension substantially matching a shape and a dimension of a leading edge of the vane; and a trailing edge passage adjacent to the radially extending hole, the trailing edge passage having a shape and a dimension substantially matching a shape and a dimension of a trailing edge of the vane;

wherein the leading edge passage and the trailing edge passage are in radial alignment with the leading edge and the trailing edge of the vane.

18. The nozzle of claim 11, wherein the actuator further comprises a rotating mechanical arm in operable connection with the vane extension journal, the mechanical arm being located on an exterior of a casing.

19. The nozzle of claim 11, wherein the nozzle further comprises:

at least one gasket disposed between the vane extension sleeve and the vane extension flange member, providing a seal; and a flange disposed radially outward of the vane extension sleeve and affixed to the vane extension sleeve, for securing a nozzle.

* * * * *